US005551889A

United States Patent [19]

Kozel et al.

[11] Patent Number: 5,551,889

[45] Date of Patent: Sep. 3, 1996

[54] LOW PROFILE INSULATION DISPLACEMENT CONNECTION PROGRAMMABLE BLOCK AND WIRE TO BOARD CONNECTOR

[75] Inventors: Charles A. Kozel, McHenry; Cathy J. Edgerton, Oakwood Hills, both of Ill.

[73] Assignee: Methode Electronics, Inc., Chicago, Ill.

[21] Appl. No.: 176,073

[22] Filed: Dec. 30, 1993

[51] Int. Cl.[6] ..... H01R 4/24

[52] U.S. Cl. ..... 439/404; 439/417

[58] Field of Search ..... 439/83, 404, 417, 439/405, 72, 49

[56] References Cited

U.S. PATENT DOCUMENTS

| | | | |
|---|---|---|---|
| 3,335,327 | 8/1967 | Damon et al. | 439/72 X |
| 4,089,041 | 5/1978 | Lolkard | 439/68 X |
| 4,138,184 | 2/1979 | Knopp | 439/404 X |
| 4,181,384 | 1/1980 | Dola et al. | 439/404 X |
| 4,192,570 | 3/1980 | Van Horn | 439/404 X |
| 4,217,022 | 8/1980 | Carré | 439/404 OR |
| 4,227,763 | 10/1980 | Marks | 439/404 OR |
| 4,545,635 | 10/1985 | Bunnell | 439/404 OR |
| 4,753,608 | 6/1988 | Yamaguchi | 439/417 X |
| 4,969,829 | 11/1990 | Sato | 439/83 OR |
| 5,125,850 | 6/1992 | Locati | 439/404 OR |
| 5,156,557 | 10/1992 | Okafuji et al. | 439/404 OR |
| 5,188,536 | 2/1993 | Ganthier et al. | 439/83 OR |

*Primary Examiner*—P. Austin Bradley
*Assistant Examiner*—Daniel Wittels
*Attorney, Agent, or Firm*—David L. Newman

[57] ABSTRACT

A wire to board connector is provided having an insulation block including cavities for insulation displacement contact which allow for programmability by insertion of wires in a predetermined orientation in cavities having contacts having contact tails for mounting on a circuit board. A terminating cover may also be provided for receiving wires therein and providing automatic termination when the terminating cover is mated with the insulation block whereby the wires inserted in the terminating cover are terminated in the corresponding cavities of the insulation block.

8 Claims, 7 Drawing Sheets

LOW PROFILE INSULATION DISPLACEMENT CONNECTION PROGRAMMABLE BLOCK AND WIRE TO BOARD CONNECTOR

BACKGROUND OF THE INVENTION

Headers and shunts are commonly used on printed circuit boards for programming a device. The present invention is an improved low cost device for providing a programmable electrical insulation displacement contact block and/or wire to board connector, having a low profile.

Devices such as headers and shunts, dip switches and hand soldering have been used to provide programmability for devices such as disk drives, garage door openers or theft deterrent systems. Such a device is assembled in a standard form and then prior to shipment needs to be programmed for a specific application or keyed with a specific code. Some of these devices are also programmed by the customer after shipment by orienting dip switches, placing shunts or soldering jumpers to provide a security code.

In a typical device, for illustration, a header is soldered or attached to a printed circuit board having multiple pairs of contacts protruding therefrom. In order to program the device, shunts are placed across specific pairs of contacts in order to short the connector across the pairs of contacts. The shunts are sometimes difficult to use or are expensive and may have too high a profile. As many devices become more and more miniaturized, lower and lower profile connectors are required.

Therefore, it is an object of the present invention to provide a programmable type shunt connector having a low profile.

It is a further objective of the present invention to provide a shunt type connector which may be manufactured at a low cost.

It is another object of the present invention to provide an insulation displacement contact and/or wire to board connection which is quickly and simply accomplished.

It is a further object of the present invention to provide a wire to board connector having a low profile.

It is another object of the present invention to provide multiple insulation displacement contact terminals in a unitary block.

SUMMARY OF THE INVENTION

A principal object of this invention is to provide an insulation displacement contact (IDC) programmable block, including at least one cavity having at least one contact member to receive an electrical wire. The IDC block further includes a contact having knife-like arms which penetrate the insulation surrounding a wire upon insertion in the cavity. The contact provides electrical contact between the wire and the contact and a printed circuit board. The IDC block includes contacts having contact tails to allow mounting of the IDC block to a printed circuit board. A terminating cover may be provided having regularly spaced passages for receiving electrical wires spaced corresponding to the channels of the IDC block. The terminating cover when mated with the IDC block, terminates the wires automatically. The terminating cover or the IDC block may be previously supplied with wires for preprogramming or a specific wire or wires could be removed from the supplied wired block or terminating cover to allow customer programming of the IDC block.

These and other features of the invention are set forth below in the following detailed description of the presently preferred embodiments.

BRIEF DESCRIPTION OF THE DRAWINGS.

There is shown in the drawings a presently preferred embodiment of the present invention, wherein like numerals in the various figures pertain to like elements, and wherein.

DETAILED DESCRIPTION OF THE PRESENTLY PREFERRED EMBODIMENTS

Figure 1:
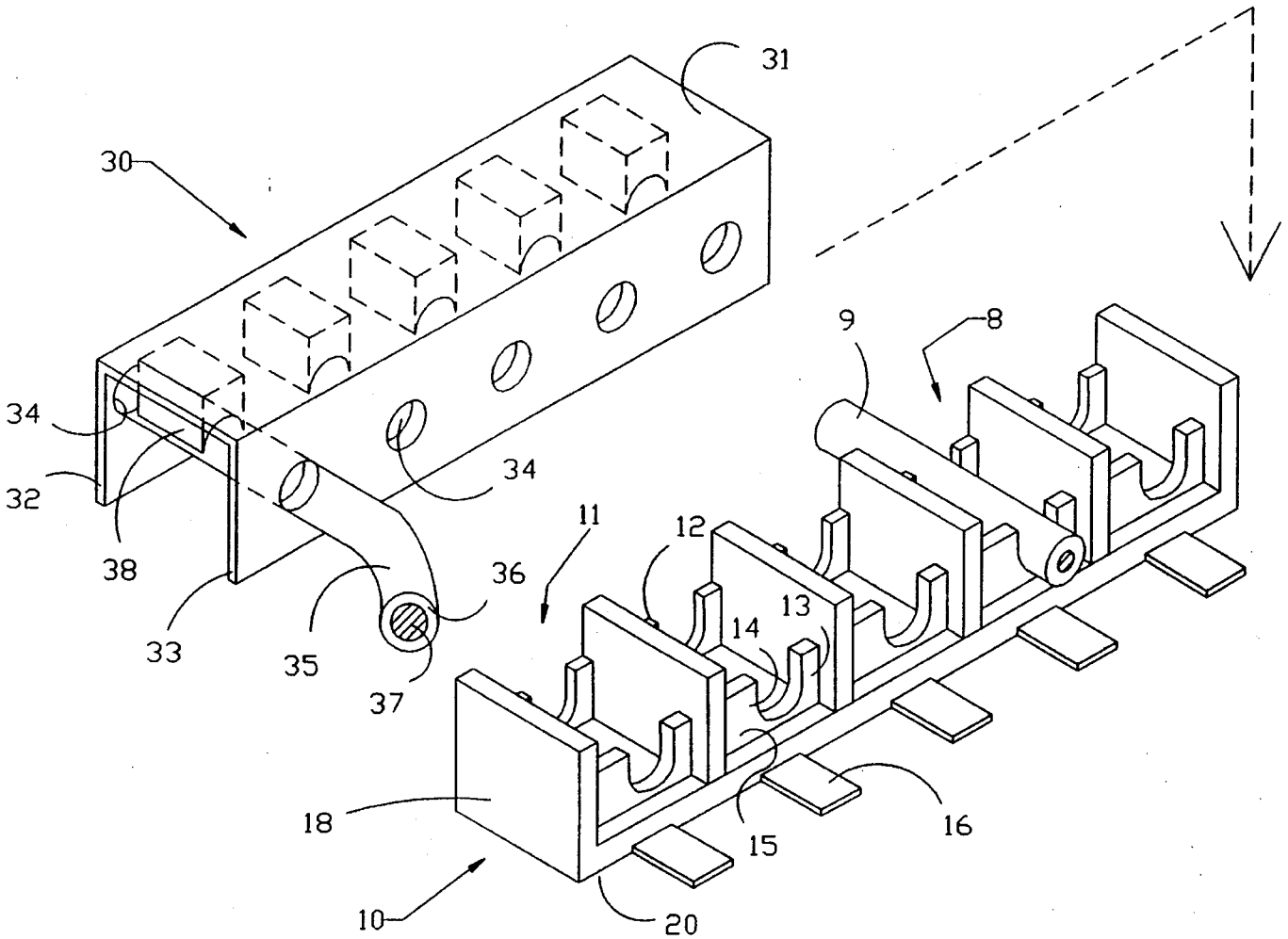
FIG. 1 s a perspective view of an IDC programmable block and terminating cover.

The present invention relates to an IDC block 10 and having cavities 11 having contacts 12 disposed therein. FIG. 1 illustrates an IDC block 10 having five cavities, however, this invention is not limited to a block having only five cavities but may have any number of cavities and contacts disposed therein. The contacts 12 in the preferred embodiment are U-shaped and have upright arms 13,14 and base 15. Protruding from the contact base 15 through the insulator 18 is a contact tail 16. FIG. 1 shows a configuration of the contact 12 providing for surface mounting to a printed circuit board, wherein the contact tail 16 is parallel to the bottom surface 20 of the block 10. In another embodiment, the contact tail may also be perpendicular to the bottom 20 of the block 10 to provide through board mounting of the block on a printed circuit board (see FIG. 6). Any contact configuration which allows mounting of the block on a printed circuit board is encompassed by this invention.

In a preferred embodiment, the insulator 18 of the block 10 is made of a polymer material such as polyester. In a preferred embodiment, the height of the IDC block 10 would be approximately 0.100 inches to 0.150 inches. This design allows for a miniaturized IDC block which will take up the smallest amount of space on a printed circuit board. Other important dimensions of a preferred embodiment of the IDC block include contact spacings on 2 mm(0.079 inches) and 2.54 mm(0.100 inches).

The programmable block invention may function alone, or it may be used in combination with a terminating cover 30. The programmable block 10 as shown in FIG. 1 may function alone by placing wires by hand into the cavities 11 and IDC'ing the wires to the block 10 to provide a programmed block for a security code or some other purpose. Any wire may be inserted in the IDC block 10. In a preferred embodiment, jumper wire 9 may be used. The jumper wire 9 does not connect to an external device but is placed across pairs of contacts 12 in order to short the IDC block 10 across the pairs of contacts in the cavity 8. The jumper wire 9 is used for programming the IDC block 10. In an alternative embodiment, color-coded wires may be preinserted in the cavities 11 and then later removed by the customer to provide the specific combination of programming required by removing some or all of the wires. However, these programming functions may also be accomplished by inserting jumper wires 9 into terminating cover 30. The present invention allows for mass termination of wires without use of special tools, complicated methods, or time-consuming methods such as soldering.

As shown in FIG. 1, a terminating cover 30 may also be used to provide simple termination of wires from an external unit inserted in the cavities 11 for wire to board termination. The terminating cover 30 includes a top 31 and two sides 32,33. Uniformly spaced along the sides 32,33 are holes 34 for receiving electrical wires. Any wire may be inserted in the cover 30. In a preferred embodiment device wire 35 which connects to an external device is used for termination of the device wire 35 to a board. The device wires 35 include insulation 36 surrounding a metal wire core 37. Corresponding to the holes 34 inside of the terminating cover 30 are support blocks 38. Upon insertion of the device wire 35 through hole 34 into the terminating cover 30 the device wire 35 will rest against support block 38. Upon mating of the terminating cover 30 with the IDC block 10 the support block 38 will terminate and retain the device wire 35 in a taught position. Upon mating of the terminating cover 30 with the IDC block 10, the contacts 12 pierce the insulation 36 and make electrical contact with the metal wire core 37. The support blocks 38 are separated a distance from the walls 32,33 of the terminating cover 30 so that upon mating with the IDC block 10 the contact arms 13,14 may pierce through and above the device wire 35 without making contact with the support block 38 or the top 31. The terminating cover 30 in a preferred embodiment is configured so that its width is greater than the width of the IDC block 10 so that the terminating cover 30 can easily mate with and fit over the IDC block 10.

Figure 2:
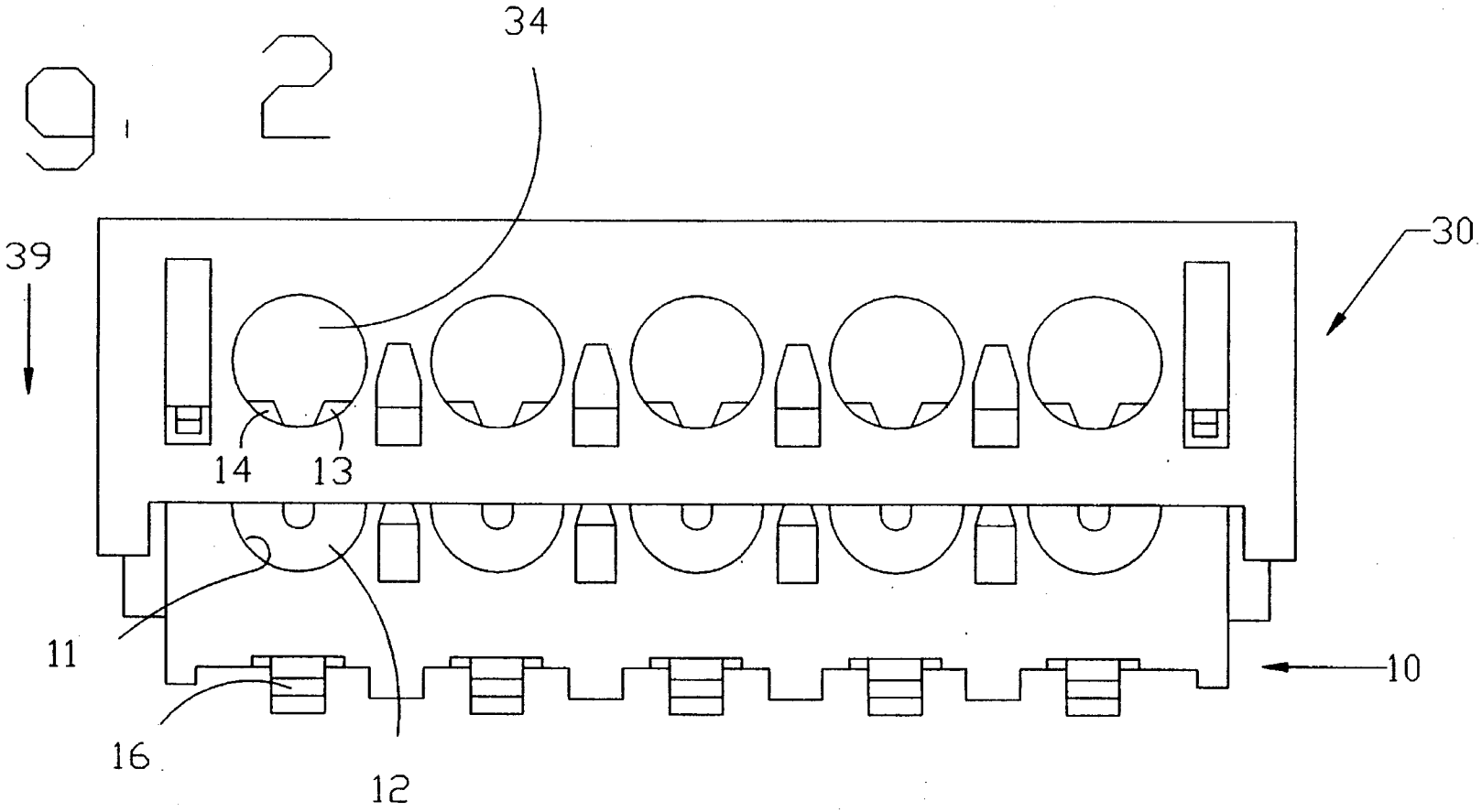
FIG. 2 is a front elevation view of an IDC block having a terminating cover staged above the terminating block.

FIG. 2 shows a front view of the combination IDC block 10 and terminating cover 30. This drawings shows the terminating cover 30 staged over the top the IDC block 10 in a partially mated configuration. It can be seen that the holes 34 align with the cavities 11 which contain contacts 12 having arms 13,14. Contact tail 16 is shown in FIG. 2 having a surface mount configuration.

Figure 3:
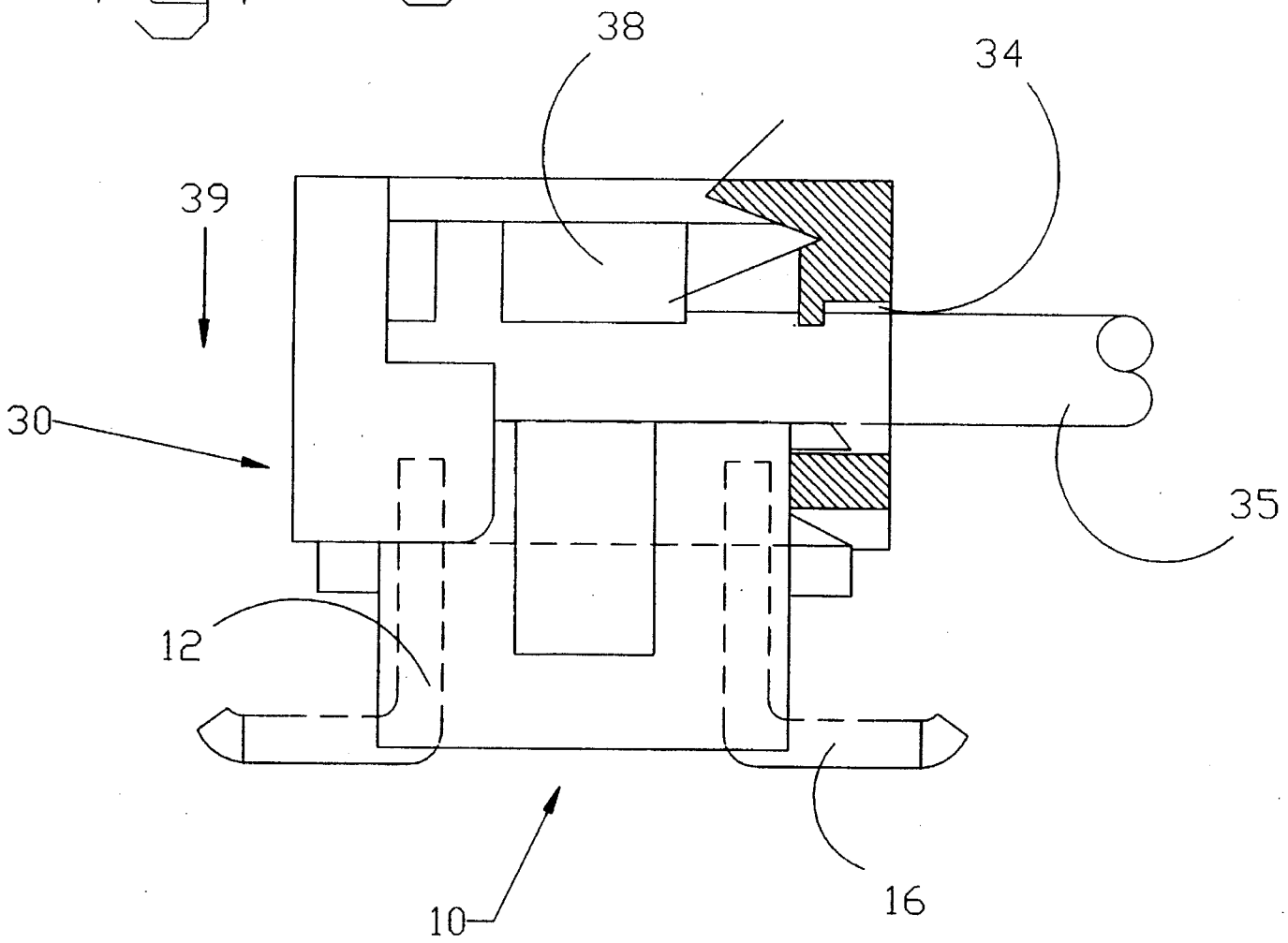
FIG. 3 s a side elevation view of an IDC block having a terminating cover staged above the IDC block.

FIG. 3 shows a side view of the IDC block 10 having a terminating cover 30 partially mated in a staged position above the IDC block 10. Device wire 35 is shown inserted in hole 34. The device wire 35 is illustrated cut-away at the end, but actually continues and connects to an external device. FIG. 3 also shows the terminating cover 30 partially cut-away so that the hole 34 containing device wire 35 is exposed. Contacts 12 are shown having a surface mount configuration wherein contact tail 16 can be mounted to a solder pad of a printed circuit board (not shown) and mounted thereto via infrared soldering or other manner. It can be seen in FIG. 3 that as the terminating cover 30 is pushed downwardly in the direction of arrow 39 the device wire 35 will come into contact with metal contacts 12.

Figure 4:
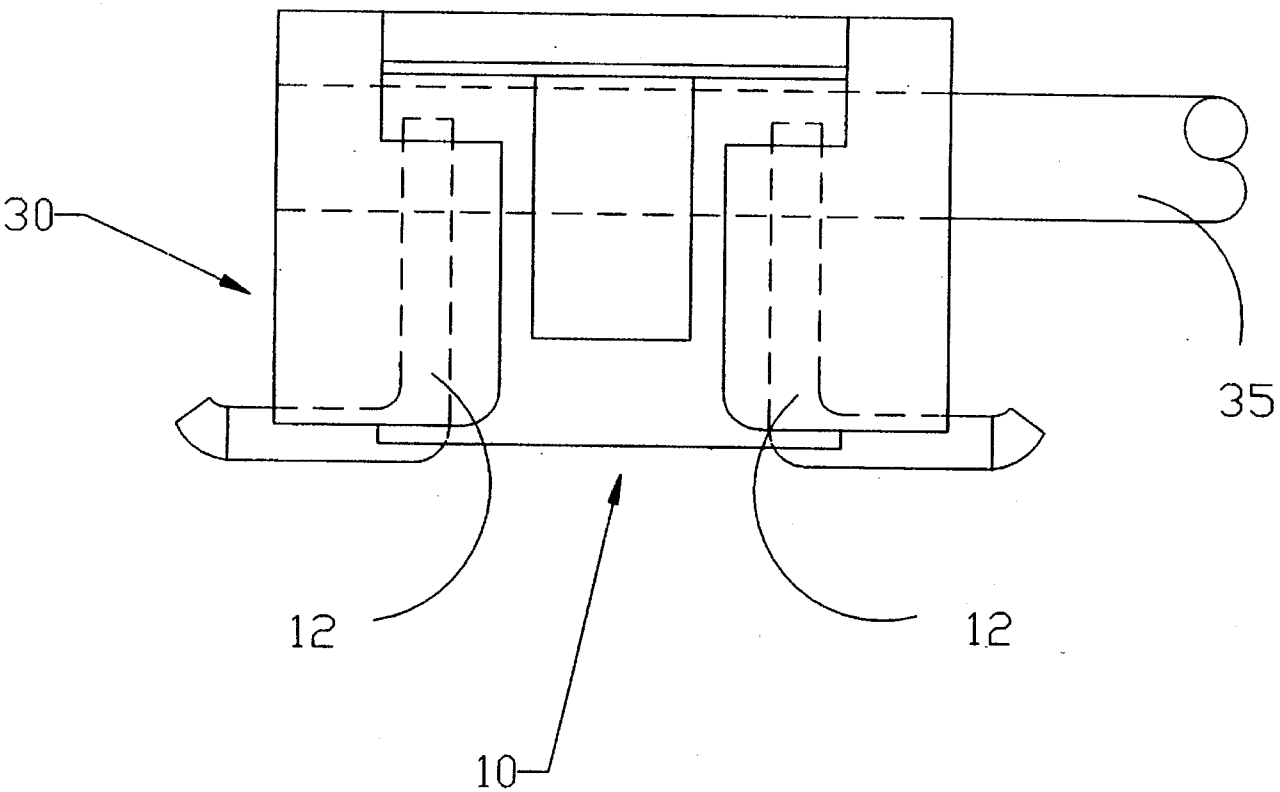
FIG. 4 is a side elevation view of the IDC block having a terminating cover fully mated to the IDC block.

FIG. 4 shows the terminating cover 30 fully mated with IDC block 10. In the fully mated configuration, it can be seen that the contacts 12 have penetrated device wire 35 providing for wire to board termination. However, the device wire 35 may also be IDC'd directly to the IDC block 10 without use of the terminating cover 30. The contacts in a preferred embodiment are formed with knife-like edges so that they may easily penetrate the insulation 36 of device wire 35.

Figure 5:
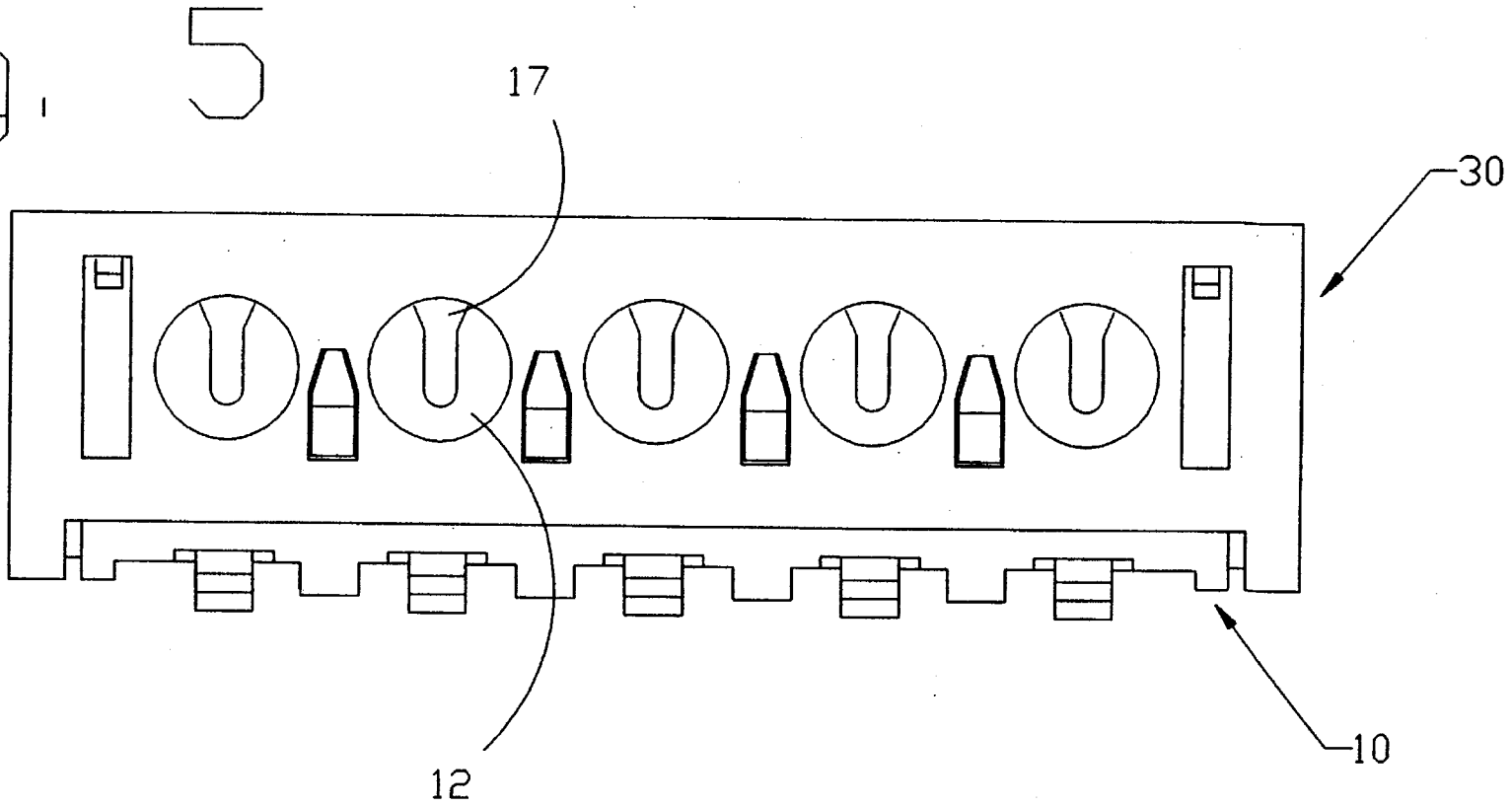
FIG. 5 is a front elevation view of an IDC block having a terminating cover fully mated to the IDC block.

FIG. 5 shows a front elevation of the IDC block 10 and terminating cover 30 in a fully mated configuration. It can be seen that contacts 12 have a narrow gap 17 so that when device wire 35 is inserted therein the arms of the contact 12 make electrical contact with the metal wire core 37 of device wire 35.

Figure 6:
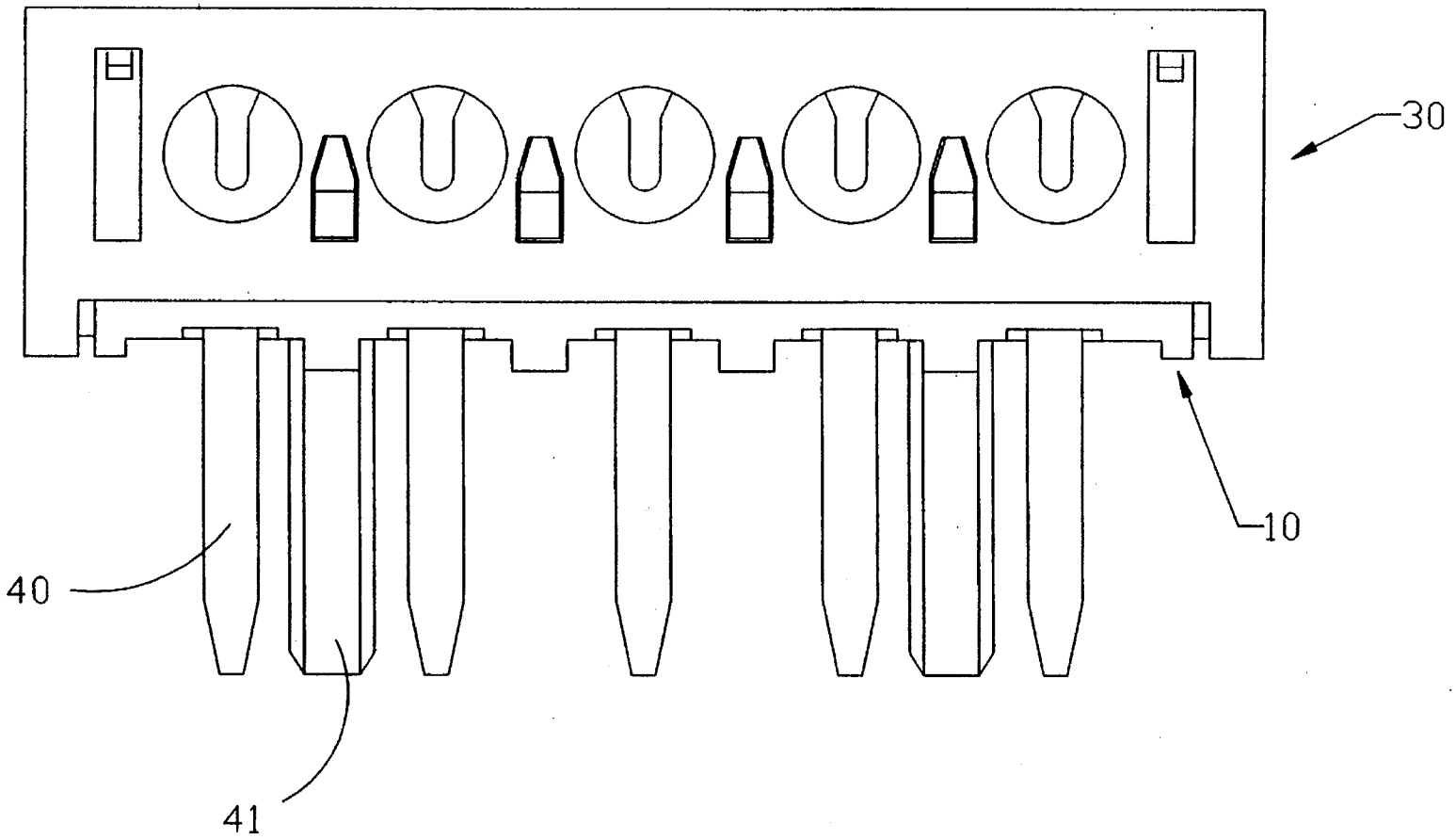
FIG. 6 is an alternative embodiment of an IDC block and terminating cover having through board contact mounting.

FIG. 6 shows an alternative embodiment of the present invention having through board contacts 40. Also shown are mounting pegs 41. This configuration allows the IDC block 10 and terminating cover 30 combination to be mounted to a printed circuit board by insertion of the through board contact tails 40 into a printed circuit board and soldered thereto. The mounting pegs 40 are also inserted in a printed circuit board to provide for proper placement of the IDC block on the printed circuit board and to maintain stable placement thereon. Other usage of mounting pegs is with blocks having surface mount tails.

Figure 7:
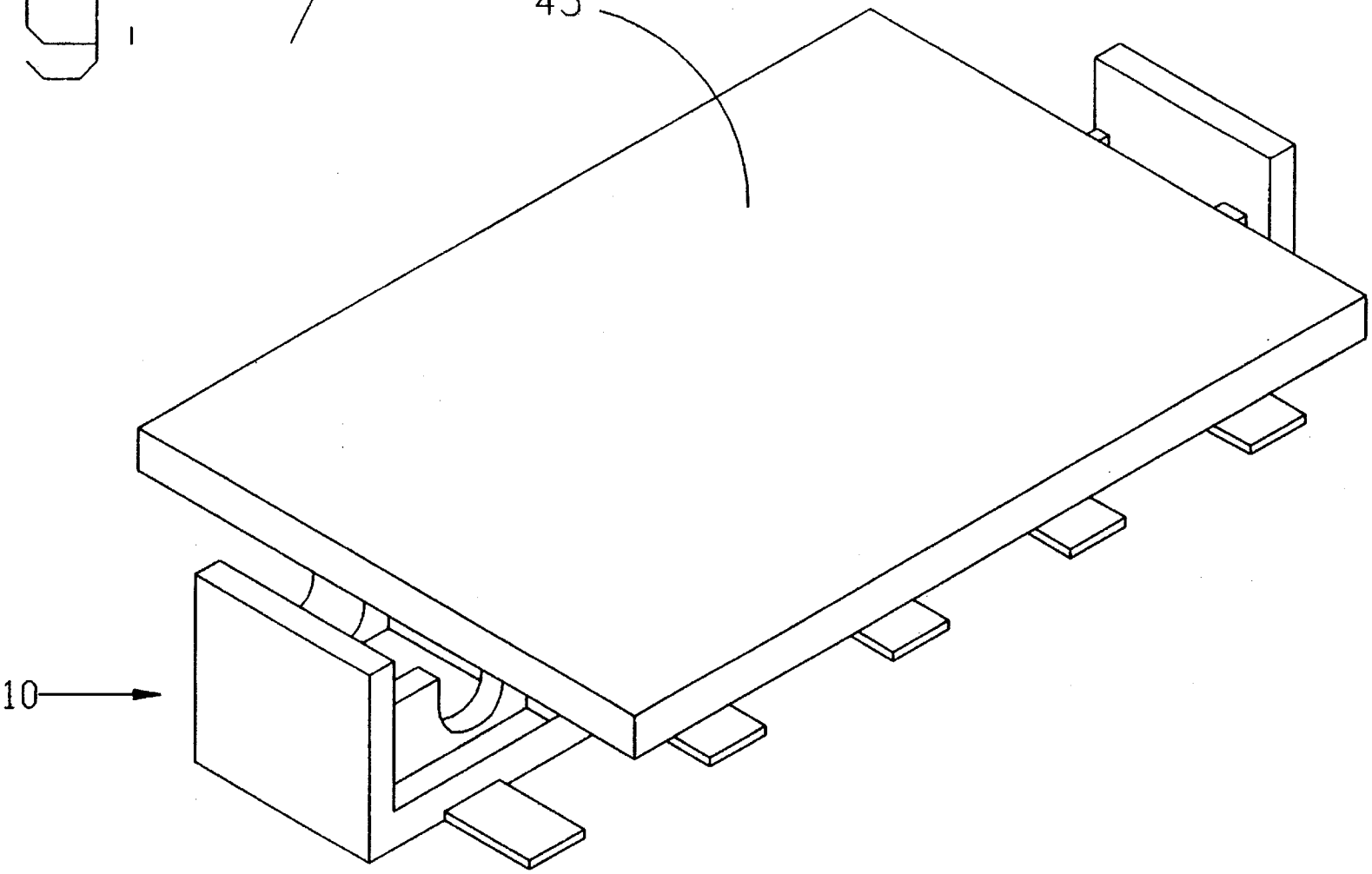
FIG. 7 is an IDC block having a further alternative configuration having cover tape attached to the IDC block.

Another alternative embodiment is shown in FIG. 7 wherein the IDC block 10 includes a cover tape 45. The cover tape 45 is temporarily adhered to the top surface of the IDC block 10 to allow for robotic assembly such as vacuum pick-and-placement of the IDC block 10 onto a printed circuit board. The cover tape 45 may be removed after the IDC block 10 is robotically placed onto the printed circuit board and mounted thereto, to allow for mating with the terminating cover.

The description above has been offered for illustrative purposes only, and it is not intended to limit the scope of the invention of this application which is defined in the following claims.

What is claimed is:

1. A wire to board connector providing insulation displacement contact (IDC) connection and programmability comprising:

an insulation block including a bottom surface and at least one cavity having at least a pair of IDC contacts mounted in said cavity for receiving a wire having insulation that is pierced by knife-like edges of the contacts, said contacts having two arms each having, length and the cavity surrounding the entire said length of the contact arms and surface mount contact tails protruding parallel to said bottom surface for mounting on a circuit board.

2. The connector of claim 1 comprising:

a terminating cover including parallel sides having at least one pair of holes, said holes for receiving said wire and correspondingly positioned to said cavity; said terminating cover matable with said insulation block.

3. The connector of claim 1 wherein said insulation block has a height of less than 0.150 inches.

4. The connector of claim 2 wherein said insulation block includes multiple cavities having a contact having two arms;

said terminating cover includes multiple holes oriented along said sides to receive said wires therein; said holes corresponding to said cavities; said wires being pierced by said arms upon mating of said insulation block with said terminating cover.

5. The connector of claim 4 wherein said terminating cover includes multiple support blocks adjacent said parallel sides; said support blocks abutting said wires and providing support of said wires upon mating of said insulation block with said terminating cover whereby said contact pushes said wire against said support block and pierces said wire.

6. A wire to board connector providing insulation displacement contact (IDC) connection and programmability comprising:

an insulation block including a bottom surface and multiple cavities having at least a pair of IDC contacts mounted in said cavities for receiving a wire having insulation that is pierced by knife-like edges of the contacts, said contacts having two arms each having a length and the cavity surrounding the entire said length of said contact arms and a surface mount contact tail protruding parallel to said bottom surface for mounting on a circuit board;

a terminating cover including parallel sides having multiple pairs of holes, said holes for receiving said wire and correspondingly positioned to said cavity, said terminating cover matable with said insulation block and said wires being pierced by said arms upon mating of said insulation block with said terminating cover.

7. The connector of claim 6 wherein said wire includes a device wire.

8. The connector of claim 6 wherein said terminating cover includes multiple support blocks adjacent said parallel sides; said support blocks abutting said wires and providing support of said wires upon mating of said insulation block with said terminating cover whereby said contact pushes said wire against said support block and pierces said wire.

* * * * *